United States Patent [19]

Fischer

[11] 4,303,137

[45] Dec. 1, 1981

[54] METHOD FOR MAKING A CONE FOR A ROCK BIT AND PRODUCT

[75] Inventor: John F. Fischer, Los Alamitos, Calif.

[73] Assignee: Smith International, Inc., Newport Beach, Calif.

[21] Appl. No.: 77,860

[22] Filed: Sep. 21, 1979

[51] Int. Cl.[3] ..... C21D 9/22

[52] U.S. Cl. ..... 175/374; 148/39; 148/12.4; 175/409

[58] Field of Search ..... 148/4, 12.4, 145, 146, 148/152, 31, 143, 150, 39; 175/374, 409

[56] References Cited

U.S. PATENT DOCUMENTS

| | | | |
|---|---|---|---|
| 3,240,639 | 3/1966 | Lihl | 148/143 |
| 3,650,846 | 3/1972 | Holland et al. | 148/39 |
| 4,047,984 | 9/1977 | Belke et al. | 148/39 |
| 4,108,692 | 8/1978 | Quinlan | 148/31 |

OTHER PUBLICATIONS

Dreger, Machine Design, Oct. 26, 1978, pp. 89–93.
Williams, Production, Nov. 1978, pp. 56–62.
Metals Handbook, 8th Ed., vol. 2, pp. 179–181, 1964.

*Primary Examiner*—R. Dean
*Attorney, Agent, or Firm*—Christie, Parker & Hale

[57] ABSTRACT

A method is provided for manufacturing tungsten carbide insert-type cutter cones for a rock bit for drilling oil wells and the like. A cone blank is formed from medium to high carbon steel by forging and machining. The cone blank has a generally conical external surface, a generally cylindrical internal bearing cavity, and a circumferentially extending ball bearing race in the bearing cavity. The cone blank is heat treated by quenching and tempering to a desired core hardness. Insert holes are drilled in the external surface of the heat treated cone blank for insertion of tungsten carbide inserts. The surface of the ball race is selectively hardened by heating and quenching for forming a surface layer having a higher hardness than the core hardness. Selective hardening of the ball race is obtained by applying energy to the surface of the ball race by induction heating, an electron beam or a laser beam to austenitize a surface layer which is rapidly cooled for hardening.

18 Claims, 7 Drawing Figures

METHOD FOR MAKING A CONE FOR A ROCK BIT AND PRODUCT

BACKGROUND

One important type of a rotary drill bit for rock drilling for oil wells and the like uses rolling cone cutters mounted on the body of the drill bit so as to rotate as the drill bit is rotated. Such a rock bit has a sturdy steel body which is threaded onto the lower end of a drill string and rotated in the hole being drilled. A number of cones, commonly three, are mounted on the rock bit body for engaging the bottom of the hole being drilled. Each of the cones is mounted on a bearing pin aligned so that as the drill bit is rotated each of the cones rotates about its own axis. High performance rock bits often include tungsten carbide inserts pressed into insert holes in the external surface of the cutter cones. These tungsten carbide inserts bear against the rock formation at the bottom of the hole, crushing and chipping the rock as drilling proceeds.

Such rock drilling is very demanding service and construction of the rock bit must be quite rugged. The cones on such a rock bit are heat treated to substantial hardness and carefully prepared bearing surfaces are needed to avoid premature bearing failure during service. Close quality control of the cones, as well as other elements of the rock bit, is essential.

Prior manufacture of tungsten carbide insert cones for rock bits has commenced with forged steel bodies of generally conical shape. Such a body is machined to form a generally cylindrical bearing cavity substantially coaxial with the conical external surface. A variety of bearing and sealing surfaces can be provided in the bearing cavity. One such surface comprises a circumferentially extending ball bearing race in the generally cylindrical cavity. It has been found desirable to have a hardness at the surface of the ball bearing race greater than the hardness of the core of the cone.

After machining the bearing cavity and, in some embodiments, portions of the external surface of the cone, the ball bearing race has been selectively carburized for enhancing hardness. The carburizing grades of steel have low carbon content, i.e., less than about 0.25% carbon. Typically low carbon steels for rock bit cones have no more than about 0.15% carbon. This assures a substantial difference in carbon content between the core and the carburized case, resulting in a relatively tough and ductile core and a high hardness case at the surface. If a higher carbon content steel were used, the heat treating cycle needed to harden the carburized case would result in excessive hardness in the core of the cone. Typical steels for forming tungsten carbide insert cones for a rock bit are types 9310, 9315, 4815, or 4820.

Carburizing of the ball bearing race involves "stopping off" areas on the cone where carburizing is not desired, such as on critical bearing surfaces. Two layers of a refractory coating are hand painted onto the surfaces of the cone where carburizing is to be inhibited. Such coatings must be carefully applied to avoid pinholes which would lead to carbon "leakage" and unwanted hard spots on the surfaces. The cone is then placed in a carburizing pack or atmosphere and held at elevated temperature for a sufficient time to produce a carburized layer on surfaces exposed through the stop-off material. A case depth of as much as 0.065 inch may be formed in order to provide excess material for subsequent machining operations. A case with a carbon content as high as 0.90% can be produced on a cone with a core carbon content of only about 0.15%. After carburizing, the cone is slowly cooled then annealed to be in suitable condition for machining.

After carburizing and annealing, the exterior of the cone is machined to its final profile. This removes the carburized case from areas where holes are later to be drilled. In some instances the cone is rough machined before carburizing and the lands where holes are to be drilled are finish machined after carburizing and annealing. This increases the number of machining set-ups. The cone is then heat treated by oil quenching from the austenitizing temperature and tempering at about 400° to 500° F. Such low temperature tempering makes little, if any, change in the as-quenched core hardness of the cone and largely relieves stress maldistribution and increases toughness, which help prevent cracking. Insert holes are drilled in the external surface of the cone for insertion of tungsten carbide inserts. Tungsten carbide inserts are press fitted in place in such holes. Various bearing surfaces in the internal bearing cavity, including the ball bearing race, are ground to final dimensions either before or after final heat treating, or before or after press fitting of the inserts.

Heat treating seeks to achieve a yield strength in the core of about 150,000 psi or a hardness of about Rockwell C-42 and a case hardness in the ball race of about C-55 to C-60. If the strength of the core is too low the press fitted tungsten carbide inserts may be loosened during use of the rock bit. Unwanted rotation or even loss of inserts can occur. If the strength and hardness of the core are too high, with consequent low ductility, breakage of a cone can occur leading to severe problems during well drilling. If the carburized case in the ball bearing race is too soft, surface damage and wear can occur as the rock bit is operated, leading to premature bearing failure. Excessive hardness in the ball race can initiate cracking which, if propagated through the wall of the cone, can result in cone breakage. Since the entire cone is heat treated after carburizing, the hardness of the carburized case is dependent at least in part on the heat treating cycle needed to obtain the desired strength in the core. Further, the higher carbon content in the carburized case can lower hardenability of the case in some steels. Complete solution of alloys and carbon in austenite may not be obtained in subsequent heat treating operations, with an adverse effect on hardness distribution in the finished cone.

Holding close tolerances on the strength and hardness of both the case and the core in a carburizing grade steel with low carbon content is quite difficult. Tempering a hardened steel core to a desired final hardness is not practical because of adverse loss of control of the hardness of the carburized case. The as-quenched core hardness in a rock bit cone is sensitive to composition of the steel, and such steel is often purchased at premium prices with composition tolerances smaller than usual steel industry standards.

In addition to the premium cost of materials and difficulty in maintaining proper core strength, the requirement for carburization of the ball race imposes substantial cost. This includes capital cost of equipment with sufficient capacity for carburizing and slow cooling the entire production volume of cones, as well as the labor of hand painting the cones to prevent unwanted carburizing. Because of the numerous steps needed for carburizing, there can be substantial work in progress in the manufacturing facility. Inadvertent carburization due to leakage through the stop-off materials can lead to hard spots on bearing surfaces and on the external surface of the cone, which can interfere with subsequent machining. Close quality control of sensitive manufacturing operations can lead to costly scrapping, reworking or diversion of a portion of the products.

It is therefore, desirable to relax the specifications for composition of steel, simplify manufacturing operations, ease quality control problems, and improve or at least not degrade the quality of tungsten carbide insert cones for rock bits.

BRIEF SUMMARY OF THE INVENTION

There is, therefore, provided in practice of this invention, a method for forming a tungsten carbide insert cone for a rock bit using medium to high carbon hardenable steel. A cone blank is formed from such steel including a generally conical external surface, a generally cylindrical internal bearing cavity, and a circumferentially extending ball bearing race in the cavity. The cone blank is heat treated to a desired core hardness and insert holes are drilled in the external surface of the cone blank for insertion of tungsten carbide inserts. The surface of the ball race is selectively heated and cooled for forming a surface layer having a higher hardness than the core hardness. Such selective hardening of the surface of the ball race can be obtained by induction heating the ball race surface, or by impinging in electron beam or other high energy beam on the surface for austenitizing a thin layer. The austenitized layer is then rapidly cooled for hardening.

DRAWINGS

These and other features and advantages of the present invention will be appreciated as the same becomes better understood by reference to the following detailed description when considered in connection with the accompanying drawings wherein.

DESCRIPTION

Figure 1:
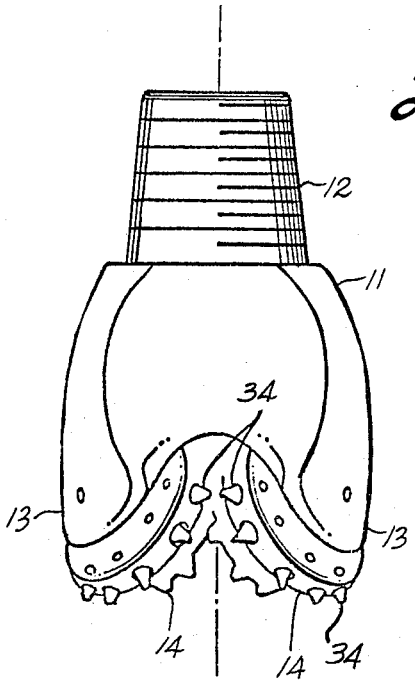
FIG. 1 illustrates the general configuration of a rock bit including cutter cones formed in accordance with practice of this invention.
Figure 2:
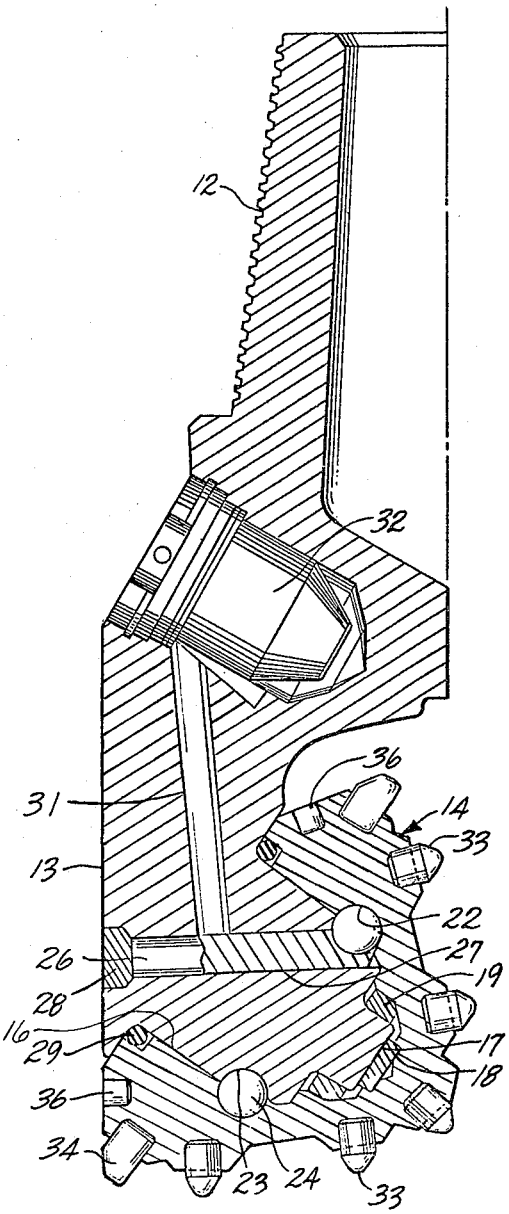
FIG. 2 is a partial longitudinal cross section illustrating mounting of such a cone on a segment of a rock bit body.

FIG. 1 illustrates in semi-schematic side view a typical three cone rock bit. The upper or shank end of the steel rock bit body 11 has a male thread 12 for connecting the rock bit to the bottom of a drill string for drilling an oil well or the like. Three legs 13 extend downwardly from the rock bit body and a cutter cone 14 is mounted on each of these legs. FIG. 2 is a longitudinal cross section through one such leg and the cone 14 mounted thereon.

At the lower end of each leg there is a generally cylindrical journal pin extending downwardly and inwardly and having an external cylindrical main bearing surface 16 near its connection to the leg. A nose bearing 17 on the end of the journal pin engages a thrust button 18 for carrying the principal thrust loads of the cone against the journal. The main bearing surface 16 and a bushing 19 carry the principal radial loads between the cone and journal. Surfaces complementary to the main bearing surface 16, bushing 19, and nose thrust button 18 are formed in a generally cylindrical internal bearing cavity 21 (FIG. 3) in the cone.

The internal bearing cavity in the cone also includes a ball bearing race 22 corresponding to a ball bearing race 23 on the journal. A plurality of ball bearings 24 are positioned in the ball races. When the cone is assembled on the journal, the ball bearings are not initially in place. These are inserted through a ball passage 26 through the leg of the rock bit and the journal. After the ball bearings 24 have been inserted in the ball race, a ball retainer 27 is inserted and fastened in place by a weld 28. The ball bearings may carry some radial or thrust load between the journal and the cone but a primary function of the balls is to retain the cone on the journal pin. High hardness is desirable in the ball race to minimize wear.

The journal bearings and ball bearings are lubricated by grease flowing through a lubricant passage 31 from a conventional grease reservoir 32 containing a pressure compensator. An O-ring 29 or similar seal prevents communication between such grease and fluids in the well being drilled.

The cone 14 has a plurality of tungsten carbide inserts 33 pressed into insert holes drilled into the generally conical external surface of the cone. These inserts include a gage row of inserts 34 at the widest portion of the cone for maintaining the gage of a hole being drilled. Heel inserts 36 are also provided in the external surface of the cone for minimizing wear of the cone adjacent the wall of the hole being drilled. The carbide inserts are commonly tungsten carbide powder composites bonded by cobalt and a variety of insert shapes can be used.

The carbide inserts are slightly larger diameter than the holes in which they are inserted. Thus, for example, an insert may be about 0.003 inch larger than the corresponding hole and a load of about 5000 pounds may be applied for pressing such an insert in place. This imposes a high stress on the steel of the cone and when drilling loads are superimposed during use, breakage of a cone can occur if the steel is not properly hardened. If the steel is too hard, the ductility and toughness may be compromised and a cone can crack. If the steel is too soft, inserts can loosen and may come out and cause damage to adjacent inserts and the cones. A loosened insert can also rotate in its mounting hole and in the case of asymmetrical inserts reduce drilling efficiency. Preferably the cone is heat treated to a core strength in the order of about 150,000 psi yield or a hardness of about 42 Rockwell C.

In practice of this invention the cutter cone 14 is made from a forging of medium to high carbon steel. Medium carbon steel contains about 0.25 to 0.55% carbon and high carbon steel contains from about 0.55 to about 1.0% carbon. Preferably, the steel selected for the cone contains about 0.40 to 0.75% carbon and is an alloy having sufficient hardenability to provide substantially uniform hardness throughout the core of the cone. A hardenability to yield at least 80% martensite at the center of a one inch section is desired. A broad variety of suitable steels can be chosen, representative examples of which include 4150H, 4340H, 8645H, 5155H, 9262H, 8655H, and the like. Preferably the carbon content of the steel is in a range to yield a hardness of about Rockwell C-55 to C-60 in a selectively hardened case as hereinafter described. Such hardness can be obtained with about 90% martensite in steel having carbon in the range of about 0.40 to 0.75%.

The forged part is machined to form the internal bearing cavity and portions of the external surface may also be machined. The cone blank so formed is oil quenched from an austenitizing temperature and tempered to produce a core strength of about 150 ksi yield. Tempering temperatures in the order of 900° to 1000° F. can reliably produce such strengths in the medium to high carbon alloy steel without great dependence on variations in chemistry of the steel. If desired, the as-quenched hardness of the cone can be checked and the tempering adjusted to achieve the desired properties in the heat treated cone.

After tempering, insert mounting holes are drilled in the external surface of the cone for insertion of tungsten carbide inserts. The ball race is selectively hardened and if desired bearing surfaces in the internal cavity can receive a final grinding. The sequence of operations can be varied as desired. For example, the selective hardening of the ball race can be before or after the insert holes are drilled and/or the carbide inserts are pressed in place.

The ball race is selectively hardened by applying energy substantially only to the surface of the ball race with an intensity and for a time interval sufficient to austenitize a layer at least about 0.01 inch thick on the surface of the ball race, and rapidly cooling the austenitized layer to form martensite. In the embodiment illustrated in FIG. 3 energy is applied to the surface of the ball race by induction heating.

Figure 3:
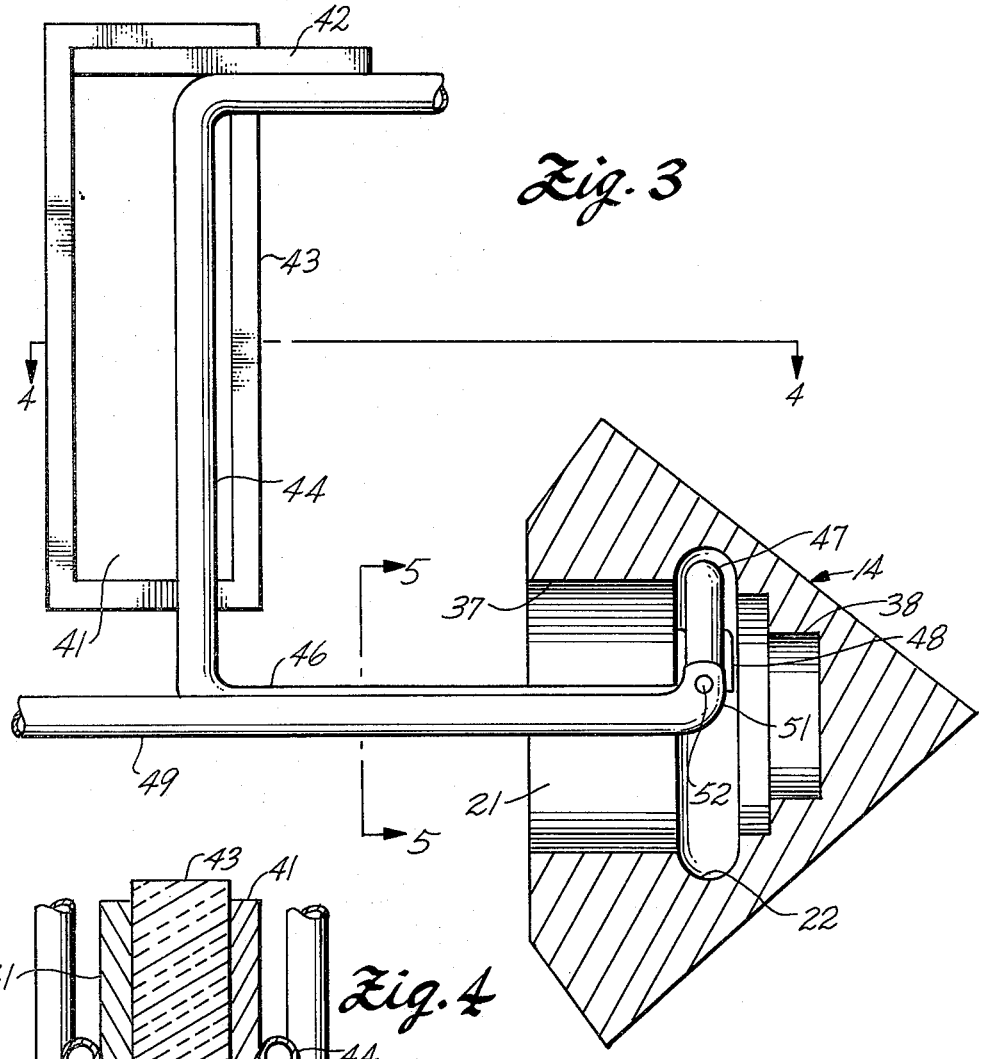
FIG. 3 illustrates in side view and partial cross section an arrangement for induction heating the ball bearing race of a cutter cone.

FIG. 3 illustrates semi-schematically the cone 14 during the selective hardening step of its manufacture. In this illustration the main bearing surface 37 and ball race 22 are shown in the generally cylindrical internal bearing cavity 21 and the nose bearing portion 38 is indicated schematically. Insert holes and tungsten carbide inserts on the generally conical external surface have been omitted from this illustration and the external surface indicated as a simple cone. It will be understood that the core 14 resembles the cone illustrated in FIG. 2.

Figure 4:
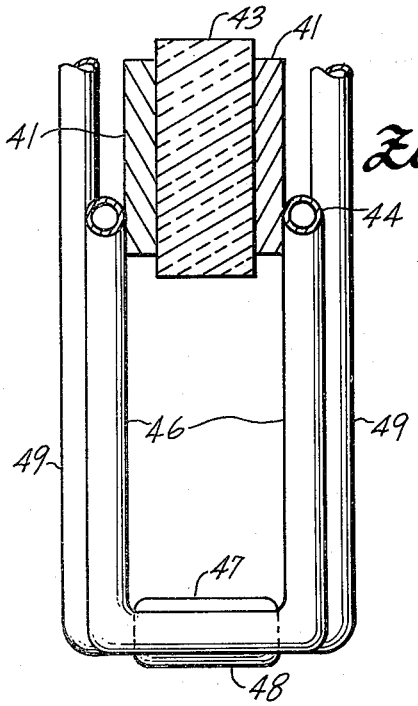
FIG. 4 is a cross section of the induction heating coil of FIG. 3.
Figure 5:
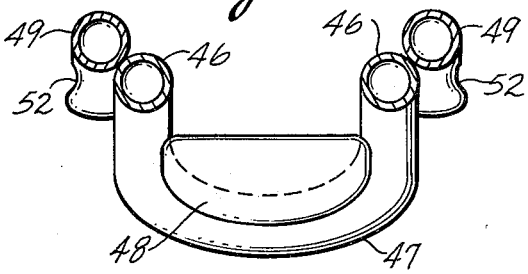
FIG. 5 is another cross section of the induction heating coil of FIG. 3.

FIG. 3 also illustrates an induction coil for selectively induction heating the ball race in the cone. Additional views of the coil are provided in the cross sections of FIGS. 4 and 5 taken on lines 4—4 and 5—5 respectively in FIG. 3. Other portions of the apparatus are omitted since they are not necessary for an understanding of this invention. Thus, for example, the induction coil is connected to a high energy power supply. Similarly, the cone is mounted in a fixture which permits rotation of the cone about its axis.

The induction heating coil comprises a pair of heavy copper bus bars 41, each of which has a wing 42 at one end for connection to the induction power supply (not shown). A high dielectric constant insulator 43 separates the bus bars to minimize energy losses and prevent shorting. A copper tube 44 is brazed to each of the bus bars 41 for conducting the induction heating current and containing a flow of cooling water to keep the coil from overheating.

The tubing 44 makes a right angle turn just beyond the end of the bus bars and has a pair of parallel spaced apart legs 46 which extend into the internal bearing cavity 21 of the cone. Within the cavity, the tubing makes another right angle turn and has a generally semi-circular portion 47 in a plane perpendicular to the parallel legs 46. The semi-circular portion 47 is substantially coaxial with the cone and during operation is in close proximity to the surface of the bearing race 22. A high dielectric constant insulator 48 is positioned within the arc of the semi-circular portion of the coil to help direct the induction field toward the surface of the ball race.

A quench liquid tube 49 is brazed to each of the parallel legs 46 of the induction coil. Each of the quench tubes has an L-shaped end 51 at an end of the generally semi-circular portion 47 of the coil. Each L-shaped end has a laterally extending hole 52 which lies near the surface of the ball race in the cone when the coil is in its operating position.

The induction coil is energized at a frequency of about 10 kilocycles or more. During this time the cone is rotated about its axis for uniform heating of the ball race. Such heating can be continued for a sufficient time for austenitizing a layer at least about 0.01 inch thick at the ball race surface. Somewhat higher power levels and frequencies and short heating times can be used as desired to effect the rapid heating of the surface without overheating the core. Generally speaking, higher frequencies tend to heat thinner layers at the surface of the ball race and can be used to obtain a thin hardened layer without excess heating of the core. After a thin layer has been austenitized, the power is turned off and coolant is forced against the surface of the ball race from the holes 52 at the ends of the two quench tubes 49. Water containing a corrosion inhibitor is a suitable coolant for rapidly quenching the ball race. A hardness in the order of about 55 to 60 Rockwell C in a layer about 0.01 to 0.02 inch thick in the ball race can be obtained. Final grinding after hardening can be avoided since little, if any, dimensional change occurs and surfaces are essentially unchanged. If it is desired to further grind the ball race after selective hardening a somewhat thicker selectively hardened case can be formed. A thin case is desirable to minimize cracking which can occur due to differential contraction when a thick case is heat treated as described. The selectively hardened case should be at least about 0.01 thick to minimize brinelling or denting of the ball race surface. A thinner case is also difficult to control in quantity production.

Preferably the rate of heating of the ball race surface is sufficiently high that the hardened case is obtained without exceeding the tempering temperature of the steel of the core at a distance more than about 0.07 inch from the ball race surface. This assures retention of adequate strength and hardness in the cone. If the core is softened to a substantial depth, there can be inadequate strength between the ball race and the bottom of nearby insert holes.

Figure 6:
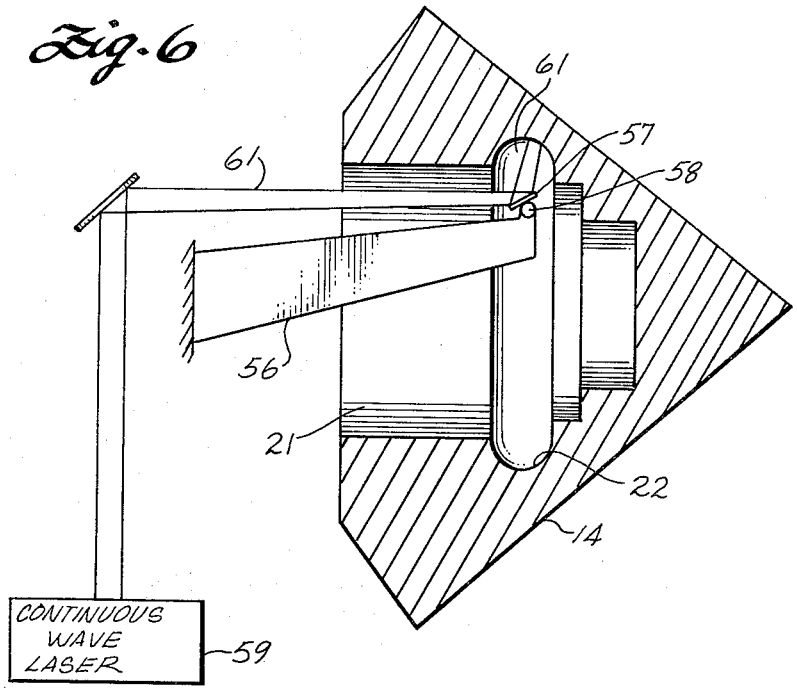
FIG. 6 is a schematic view of a technique for selectively heating a ball bearing race in a cutter cone by means of a laser beam.

Alternatively, energy can be applied rapidly to the surface of the ball race for austenitizing a thin layer by means of a continuous wave laser. Such an arrangement is illustrated schematically in FIG. 6. In such an embodiment a fixed arm 56 extends into the internal bearing cavity 21 of the cone 14. A small mirror 57 is mounted on a pivot 58 on the end of the arm. A continuous wave laser 59 such as, for example, a 5 kilowatt or larger carbon dioxide laser directs a high intensity beam 61 onto the mirror 57. The mirror 57 is oscillated back and forth as the cone is rotated about its axis so that the laser beam follows a raster pattern sweeping over the surface of the ball race 22. The oscillation of the mirror 57 is controlled for uniformly irradiating the surface of the ball race and obtaining a desired depth of austenitized layer. The surface of the ball race can be darkened as by application of a phosphate conversion coating, for example, to assure adequate absorption of the laser beam and rapid heating of the surface.

When an adequate layer of steel adjacent the ball race surface has been heated to the austenitizing temperature, irradiation by the laser beam is stopped and the steel rapidly cooled for selectively hardening the ball race. Such cooling can be by application of external coolant directed against the ball race surface or the cone can "self quench." Thus, when a thin layer of steel adjacent the surface is heated and the balance of the cone remains at about ambient temperature due to the very short interval of heating, the surface layer can quench to form martensite merely by conduction of heat from the surface layer into the balance of the cone. With rapid heating and reasonably hardenable steel, such self quenching can be adequate for selectively hardening the ball race.

Figure 7:
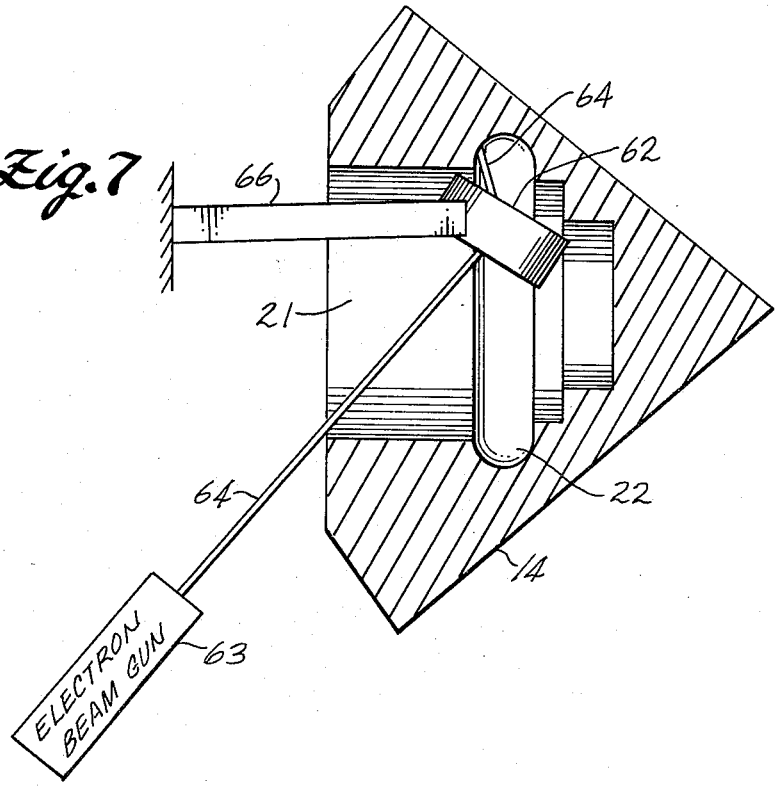
FIG. 7 illustrates schematically a technique for selectively heating a ball bearing race by means of an electron beam.

FIG. 7 illustrates schematically another embodiment wherein the surface of the ball race is rapidly heated to its austenitizing temperature for selective hardening. In this embodiment a fixed arm 66 extends into the internal bearing cavity 21 of the cone 14. A controllable magnetic deflection coil 62 is mounted on the end of the arm adjacent the ball race 22. An electron beam gun 63 directs an electron beam 64 into the deflection coil. The magnetic field of the deflection coil is varied as the cone is rotated about its axis so that the electron beam 64 is caused to scan across the ball race surface. The electron beam penetrates the surface and effects rapid heating of a thin layer adjacent the surface. After a thin layer on the ball race surface has been austenitized, the layer is cooled rapidly by self quenching, or application of an external quench medium, or both, for selectively hardening the ball race.

Such a manufacturing technique for a cone for a rock bit reduces operations and avoids carbon leakage problems involved in carburizing operations. This technique also relaxes quality control difficulties involved in hardening low carbon carburizing grade steels. Thus, instead of maintaining tight control on the chemistry of a low carbon steel in order to obtain a desired core strength, a medium to high carbon steel can be used to obtain a high strength core with only nominal control of chemistry and straightforward heat treatment. The medium to high carbon steel can be oil quenched to a hardness of about 50 Rockwell C and the tempering temperature adjusted slightly to control core hardness at about 42 Rockwell C without affecting the hardness of the selectively hardened ball race.

Although this technique has been described for selective hardening of the ball race in the internal bearing cavity of a rock bit cone, it will be apparent that other areas on the rock bit cone can be selectively hardened, if desired. Thus, for example, the area engaged by the thrust button at the nose of the journal pin or the seal surface can be selectively hardened. Since these or other variations can be made by one skilled in the art, the scope of this invention is to be limited only by the following claims.

What is claimed is:

1. A process for forming a tungsten carbide insert cone for a rock bit comprising the steps of:

forming a cone blank from a medium to high carbon hardenable steel, the cone blank including a generally conical external surface, a generally cylindrical internal bearing race in the bearing cavity;

heat treating the cone blank to a desired core hardness;

forming insert holes in the external surface of the cone blank for insertion of tungsten carbide inserts;

applying energy substantially only to the surface of the ball race for a time interval and with an intensity sufficient to austenitize a layer at least about 0.01 inch thick adjacent the ball race surface; and cooling the austenitized layer sufficiently rapidly to form martensite.

2. A process as claimed in claim 1 wherein the heat treating comprises quenching the cone blank from an austenitizing temperature for producing a relatively higher core hardness and tempering the cone blank for reducing the core hardness, and wherein energy is applied sufficiently rapidly to the ball race surface to avoid exceeding the tempering temperature of the cone blank at a depth of more than about 0.07 inch from the ball race surface.

3. A process as recited in either claim 1 or claim 2 wherein energy is applied by placing an induction coil adjacent a portion of the ball race, and rotating the cone about the induction coil for exposing the circumference of the ball race to energy from the induction coil for heating the ball race surface; and thereafter the ball race surface is quenched by directing coolant against the ball race surface.

4. A process as recited in either claim 1 or claim 2 wherein the step of applying energy comprises directing an electron beam against a portion of the ball race surface and rotating the cone about its axis for exposing the circumference of the ball race to the electron beam for heating the ball race surface above the austenitizing temperature of the steel.

5. A process as recited in either claim 1 or claim 2 wherein the step of applying energy comprises directing a high energy beam against a portion of the ball race surface and rotating the cone about its axis for exposing the circumference of the ball race to the high energy beam for heating the ball race surface above the austenitizing temperature of the steel.

6. A process as recited in either claim 1 or claim 2 wherein the step of applying energy comprises induction heating the ball race surface.

7. A process for forming a tungsten carbide insert cone for a rock bit comprising the steps of:

forming a cone blank from a steel containing about 0.40 to 0.75% carbon, the cone blank including a generally conical external surface, a generally cylindrical internal bearing cavity and a circumferentially extending ball bearing race in the bearing cavity;

heating the cone blank to an austenitizing temperature and quenching the cone blank for producing a relatively higher core hardness in the cone blank;

tempering the cone blank for reducing the core hardness of the cone blank;

forming insert holes in the external surface of the cone blank for insertion of tungsten carbide inserts;

placing an induction coil adjacent a portion of the ball race;

rotating the cone about the induction coil for exposing the circumference of the ball race to energy from the induction coil for heating substantially only the ball race surface; and thereafter cooling the ball race surface sufficiently rapidly for selectively hardening the ball race surface to a hardness greater than the hardness of the core.

8. A process as recited in claim 7 wherein the cooling step comprises directing coolant against the ball race surface for quenching the ball race surface.

9. A process for forming a tungsten carbide insert cone for a rock bit comprising the steps of:

forming a cone blank from a steel containing about 0.40 to 0.75% carbon, the cone blank including a generally conical external surface, a generally cylindrical internal bearing cavity and a circumferentially extending ball bearing race in the bearing cavity;

heating the cone blank to an austenitizing temperature and quenching the cone blank for producing a relatively higher core hardness in the cone blank;

tempering the cone blank for reducing the core hardness of the cone blank;

forming insert holes in the external surface of the cone blank for insertion of tungsten carbide inserts;

directing an electron beam against a portion of the ball race surface and rotating the cone blank for exposing the circumference of the ball race to the electron beam for heating the ball race surface above the austenitizing temperature of the steel; and cooling the ball race surface sufficiently rapidly for selectively hardening the ball race surface to a hardness greater than the core hardness of the cone.

10. A process for forming a tungsten carbide insert cone for a rock bit comprising the steps of:

forming a cone blank from a steel containing about 0.40 to 0.75% carbon, the cone blank including a generally conical external surface, a generally cylindrical internal bearing cavity and a circumferentially extending ball bearing race in the bearing cavity;

heating the cone blank to an austenitizing temperature and quenching the cone blank for producing a relatively higher core hardness in the cone blank;

tempering the cone blank for reducing the core hardness of the cone blank;

forming insert holes in the external surface of the cone blank for insertion of tungsten carbide insert;

directing a high energy beam against a portion of the ball race surface and rotating the cone for exposing the circumference of the ball race to the high energy beam for heating a thin layer at the ball race surface above the austenitizing temperature of the steel; and cooling the ball race surface sufficiently rapidly for selectively hardening the ball race surface to a hardness greater than the core hardness of the cone.

11. A process for forming a tungsten carbide insert cone for a rock bit comprising the steps of:

forming a cone blank for medium to high carbon hardenable steel, the cone blank including a generally conical external surface, a generally cylindrical internal bearing cavity, and a circumferentially extending ball bearing race in the bearing cavity;

heating the cone blank to an austenitizing temperature and quenching the cone blank for producing a relatively higher core hardness;

tempering the cone blank for reducing the core hardness;

forming insert holes in the external surface of the cone blank for insertion of tungsten carbide inserts; and selectively heating and cooling substantially only the surface of the ball race for forming a surface layer in the ball race having a hardness greater than the core hardness of the cone after tempering.

12. A process as recited in claim 11 wherein the ball race is heated by placing an induction coil adjacent a portion of the ball race; and rotating the cone about the induction coil for exposing the circumference of the ball race to energy from the induction coil.

13. A process as recited in claim 12 wherein the ball race is cooled by directing coolant against the ball race surface for quenching the ball race surface sufficiently rapidly to form martensite.

14. A process as recited in claim 11 wherein the ball race surface is heated above the austenitizing temperature of the steel by directing an electron beam against a portion of the ball race surface and rotating the cone for exposing the circumference of the ball race to the electron beam.

15. A process as recited in claim 11 wherein the ball race surface is heated above the austenitizing temperature of the steel by directing a high energy beam against the ball race surface and rotating the cone for exposing the circumference of the ball race to the high energy beam.

16. A tungsten carbide insert cone for a rock bit comprising: a steel cone body having a carbon content in the range of from about 0.40 to 0.75% including a generally conical external surface, a generally cylindrical internal bearing cavity, and a circumferentially extending ball bearing race in the bearing cavity, the steel in the core of the cone having a strength of about 150,000 psi yield, a layer of steel having a thickness of at least about 0.01 inch in the ball race having a hardness in the order of about 55 to 60 Rockwell C and a carbon content the same as the carbon content of the core; and a plurality of tungsten carbide inserts in holes in the external surface of the cone.

17. A cone as recited in claim 16 wherein the thickness of the layer in the ball race is less than about 0.07 inch.

18. A cone as recited in claim 16 wherein the thickness of the layer in the ball race is in the range of from about 0.01 to 0.02 inch.

* * * * *

UNITED STATES PATENT AND TRADEMARK OFFICE

CERTIFICATE OF CORRECTION

PATENT NO. : 4,303,137

DATED : December 1, 1981

INVENTOR(S) : John F. Fischer

It is certified that error appears in the above—identified patent and that said Letters Patent is hereby corrected as shown below:

Column 3, line 30, "in" should be -- an --.
Column 5, line 5, -- 4350H -- should be inserted after "4340H" and before "8645H".
Column 8, line 9, -- cavity and a circumferentially extending ball bearing -- should be inserted after "bearing" and before "race".

Signed and Sealed this

*Second* Day of *February 1982*

[SEAL]

*Attest:*

GERALD J. MOSSINGHOFF

*Attesting Officer*

*Commissioner of Patents and Trademarks*